United States Patent [19]

Weyandt

[11] 4,392,056

[45] Jul. 5, 1983

[54] CONTROL MARKING DETECTOR

[75] Inventor: Ronald R. Weyandt, Chesterland, Ohio

[73] Assignee: Automated Packaging Systems, Inc., Twinsburg, Ohio

[21] Appl. No.: 253,193

[22] Filed: Apr. 27, 1981

[51] Int. Cl.[3] ..... G01J 1/00; F21V 9/16

[52] U.S. Cl. ..... 250/339; 250/458.1; 250/461.1; 250/223 R; 235/468; 235/476; 382/65

[58] Field of Search ..... 250/339, 458.1, 459.1, 250/461.1, 223 R, 548, 567; 235/468, 476

[56] References Cited

U.S. PATENT DOCUMENTS

| | | |
|---|---|---|
| 2,929,931 | 3/1960 | Richter et al. . |
| 3,105,908 | 10/1963 | Burkhardt et al. . |
| 3,162,642 | 12/1964 | McCafferty . |
| 3,204,842 | 9/1965 | Reimann . |
| 3,237,973 | 3/1966 | Rumberger . |
| 3,492,478 | 1/1970 | Smith . |
| 3,525,872 | 8/1970 | Schneider . |
| 3,599,389 | 8/1971 | Hartman . |
| 3,614,430 | 10/1971 | Berier . |
| 3,671,451 | 6/1972 | Butterfield . |
| 3,673,418 | 6/1972 | Wiig . |
| 3,701,464 | 10/1972 | Crum . |
| 3,760,161 | 9/1973 | Lohne et al. . |
| 3,783,293 | 1/1974 | Gold et al. . |
| 3,820,068 | 6/1974 | McMillin . |
| 3,909,594 | 9/1975 | Allais et al. . |
| 4,013,893 | 3/1977 | Hertig . |
| 4,015,131 | 3/1977 | McDonough et al. . |
| 4,020,357 | 4/1977 | Punis . |
| 4,047,023 | 9/1977 | Key et al. . |
| 4,114,804 | 9/1978 | Jones et al. . |
| 4,237,378 | 12/1980 | Jones . |

*Primary Examiner*—Davis L. Willis

*Attorney, Agent, or Firm*—Watts, Hoffmann, Fisher & Heinke

[57] ABSTRACT

A detector 10 used to sense the presence of control markings 20 on a moving web 12. The detector responds to abrupt changes in intensity of electromagnetic radiation rather than merely to absolute intensity values. Gradual changes in or a constant level of detected radiation or detector temperature do not change the magnitude of the abrupt changes in radiation intensity to which the detector responds. This capability allows the detector to distinguish between electromagnetic radiation emitted by wavelength-shifting control marks 20 and changes in web background and/or ambient radiation. A filter 38 is interposed between a photo diode 36 in the detector 10 and the web 12 to further enhance detector performance.

14 Claims, 3 Drawing Figures

CONTROL MARKING DETECTOR

DESCRIPTION

1. Technical Field

This invention relates to a radiation detector and more particularly to a detector adapted to sense the presence of indicia on an article such as a web moving in relation to the detector to control one or more control functions to be performed on or with the article.

2. Background Art

Radiation detectors useful in scanning moving objects which contain position coordinating indicia are known in the art. Typically such detectors employ visible radiation sensitive detectors which scan an object for the presence of a visible mark fixed to or forming a portion of the object. Once the indicia or marking is detected, it is known that the object being scanned is positioned at a particular point in relation to the detector. This information makes it possible to coordinate movement control and/or use of the object in response to control signals generated by the detector.

Marking schemes for use with the herein disclosed detector are described in a copending patent application entitled "Continuous Web Registration" to Hershey Lerner and Bernard Lerner, Ser. No. 166,500, filed July 7, 1980, which is incorporated herein by reference. One such scheme utilizes a laser dye ink for affixing control indicia onto a web. The laser dye indicia emit nonvisible wavelength-shifted radiation in the infrared spectrum when exposed to high-intensity electromagnetic radiation of an appropriate wavelength. Another scheme utilizes a chemical marketed by Sandoz Chemicals under the tradename TH-40. The idicia ink made with Sandoz TH-40 forms an ordinarily invisible mark which emits wavelength-shifted electromagnetic radiation when exposed to incident radiation of an appropriate spectrum. A system disclosed in the above-referenced patent application utilizes indicia and a detector to control operations to and use of a moving web. When the indicia are irradiated with electromagnetic energy of a predetermined wavelength, the indicia emit electromagnetic radiation shifted in wavelength, which can be detected and used to generate control signals.

In the manufacture of webs or in the use of webs, continuous strips of material, such as plastic, are moved relative to apparatus that prints, seals, scores, severs, fills pockets, or performs other operations on or with the web. This requires accurate positioning or registration of the web with work stations. Because of cumulative error from tolerances and web stretch, the web is repeatedly registered at each work station using repetitive printed indicia on the web, sensed each time an operation is to be performed. The indicia are sensed by detecting the presence of radiation eminating from the indicia at a certain minimum intensity.

Marking schemes used with webs have presented problems when the marks or indicia were affixed to multicolored or varying backgrounds. For example, plastic webs used in the packaging art often include colorful designs and/or logo areas which are different for various webs. Detection of the position-indicating marks on varying backgrounds has presented problems due to the variability in radiation reflected from the web. A detector which responds only to radiation intensities can be "fooled" when marks are affixed to different backgrounds that reflect light to different degrees. An absolute-intensity-level radiation detector, for example, might generate the same output signals from a good reflector, such as a light-colored background having no marking, and from a control mark that fluoresces on a dark background. The detector may therefore erroneously initiate a control where none is appropriate.

This problem with the prior art radiation detectors stems from an inability to distinguish radiation from a control mark and reflected radiation from the web and/or ambient radiation in the vicinity of the detector. The detector may respond to a broad range of incident electromagnetic radiation of varying wavelengths even though the control marks emit only a narrow range of radiation. The marks disclosed in the above-referenced patent application, for example, only produce a wave shift with a particular rather narrow band of wavelengths. Since the detector disclosed in the above-mentioned application utilizes a photodiode that responds to other wavelengths, however, care must be taken to avoid the possibility that reflected rather than wave-shifted light emitted from the marks will activate the detector.

DISCLOSURE OF THE INVENTION

The present invention overcomes possible inaccuracies in prior art detecting systems by providing a detector that reliably senses the presence of a mark on a moving article even though the mark appears on varying backgrounds. In particular, it reduces the incidence of spurious control signals and misregistration of the moving article caused by an inability of prior art detectors to discriminate between a mark and a reflective background.

According to the invention, the present detector responds to sudden changes in radiation intensity rather than absolute incident radiation levels. A filter is interposed between the moving article and the detector to filter out all but a particular range of wavelength radiation. Since the marking is chosen to re-emit radiation of a particular narrow wavelength, the filter enhances the sensitivity of the detector by causing it to respond primarily to the narrow band of radiation rather than to all ambient radiation in the region of the article.

In the preferred embodiment of the invention the invention includes a radiation responsive element mounted in close relation to a path of travel of a web. A source of electromagnetic radiation of a predetermined wavelength is mounted in close proximity to the path to cause marks on the web to emit wavelength-shifted radiation as the marks pass the radiation-responsive element.

A filter, which transmits the wavelength-shifted radiation but attenuates all other wavelengths of light, is interposed between the web and the radiation responsive element. Circuitry coupled to the element generates a control output signal only in response to abrupt changes in intensity of radiation of the wave-shifted length. The occurrence of an output signal is an indication that a control mark leading edge has been detected and can be used to coordinate web movement with fabrication or other process functions.

The circuitry includes a differential amplifier having a first input coupled to the radiation responsive element and a second input feedback coupled to an amplifier output through an energy storage device. The feedback coupled input causes the second input to track or follow the first input for slowly varying changes in or for a constant level of the first input. Due to this feedback circuitry the output from the differential amplifier only changes in response to rapid changes in the input from the radiation responsive element. The differential amplifier output is coupled to circuitry that allows the user to tune the detector so that a change in radiation intensity, to be detectable, must not only be abrupt but also of a certain amplitude. This feature presents a safeguard against false detector activation by the web background, since changes in radiation intensity caused by variations in the web background are typically not great enough to produce a differential amplifier output once the circuitry has been tuned. In essence, the detector discounts a constant or slowly changing base level intensity of the ambient or incident radiation reflected by the web. As a result, mere pattern variations on the web, as distinguished from wave-shifting marks, will not create a sufficient increase in intensity of reflected radiation to trigger a response by the detector, notwithstanding a situation where the total intensity level is created largely by a relatively high base level intensity—possibly as high as a level sufficient to trigger a response from a wave-shifting mark on a much less-reflective web.

Use of the amplifier feedback input also avoids problems in detector operation caused by temperature variations. Detectors that use absolute value sensors may change in their operating characteristics so the change in incident radiation needed to trigger the detector becomes very small. When this occurs problems caused by variation in web background are exacerbated. The feedback circuitry of the present invention avoids detector sensitivity changes with temperature because the change in feedback signal to the amplifier with circuitry temperature variations is gradual, whereas detector response requires rapid changes in the feedback signal.

In addition to the differential amplifier, certain waveform-shaping amplifiers are included in the circuitry, which cause a well defined square wave output signal to be generated in response to the presence of the marking on the web. The time duration of this square wave output may be controlled to provide a signal particularly adapted for a particular web control system.

From the above it should be appreciated that one object of the present invention is the provision of a detector that is sensitive to changes in radiation intensity caused by markings affixed to a moving web. The detector avoids misregistration of the web by responding only to changes in light intensities rather than absolute intensity levels. By practice of the invention accurate web registration is achieved in a simple yet reliable manner to avoid waste in time and materials caused by web misregistration. Other features and objects of the present invention will become better understood when considered in conjunction with a detailed description of a preferred embodiment of the invention which follows.

BEST MODE FOR CARRYING OUT THE INVENTION

Figure 1:
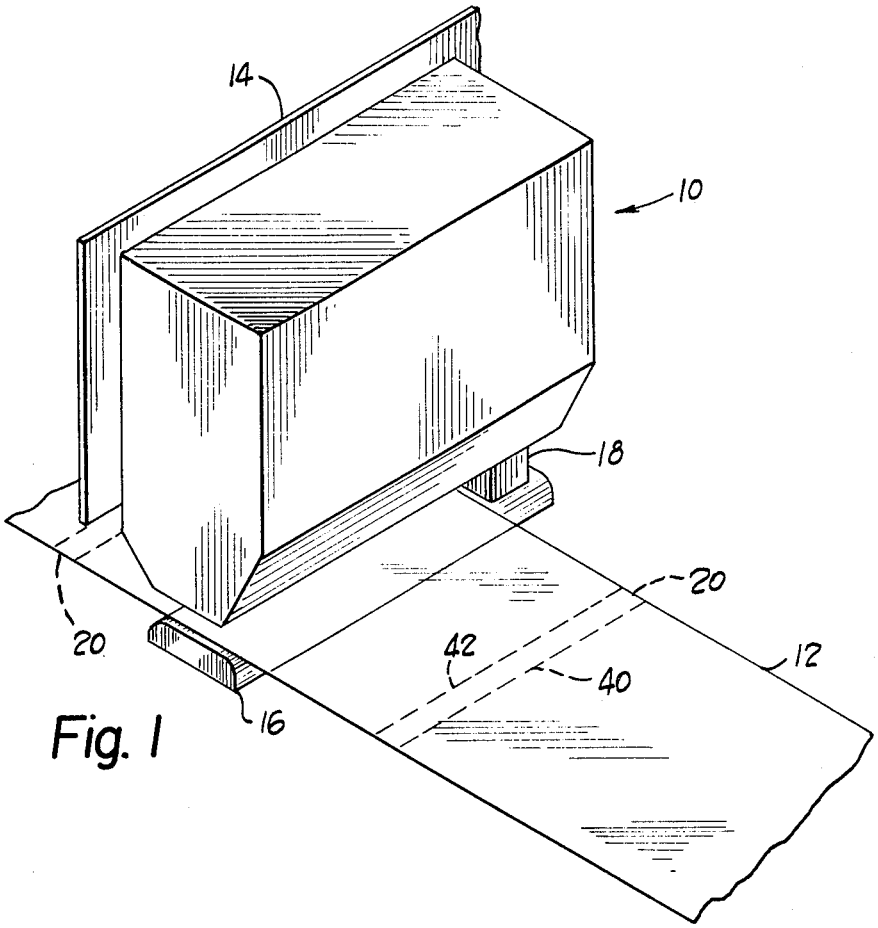
FIG. 1 is a perspective view of a detector for controlling fabrication and/or use of a moving web which includes control markings.
Figure 2:
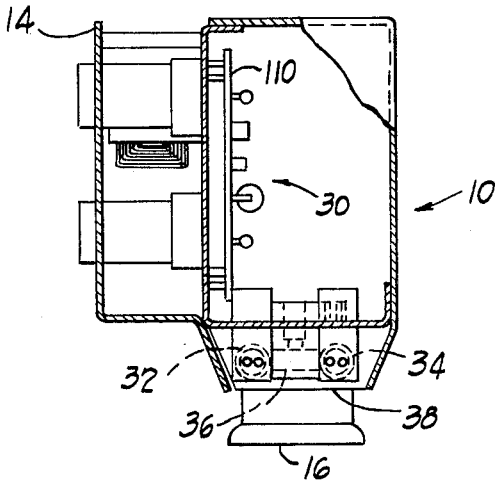
FIG. 2 is a partially sectioned elevation view of the detector shown in FIG. 1.

Turning now to the drawings, a preferred detector unit 10 for detecting the presence of markings along a web is shown in FIG. 1. This unit is mounted in proximity to a moving web 12 by a detector mounting plate 14. The web 12 is caused to move beneath the detector by an appropriate drive (not shown). A web guide 16 is positioned beneath the detector 10 and is attached to it by a suitable support 18. This guide 16 allows the web to pass beneath the detector at a distance close enough to allow the detector to sense the presence of marks 20 on the web. Control circuitry 30 mounted inside the unit 10 (see FIG. 2) generates signals which control fabrication or manufacturing processes to be performed to the moving web as the marks 20 move past the detector.

Several materials suitable for use as the marks 20 are disclosed in a copending U.S. patent application to Harold Waitz and Hershey Lerner entitled "Nonmigrating Control Indicia for a Plastic Web or Sheet Article", Ser. No. 166,499, filed July 7, 1980, which is incorporated herein by reference. One material comprises KODAK I. R. 125, a laser dye, mixed with a clear varnish vehicle. A mark printed with this material emits nonvisible wavelength shifted electromagnetic radiation of about 9400 angstroms when exposed to incident radiation of about 7950 angstroms. Another comprises an ionic fluorescing compound sold by The Sandoz Chemical Company under the tradename TH-40. When mixed with a suitable varnish the TH-40 is transparent and when illuminated with ultraviolet radiation of about 3600 angstroms emits visible light radiation of about 4500 angstroms.

Mounted inside the detector unit 10 are two sources 32, 34 of electromagnetic radiation, e.g., infra red or ultra-violet radiation. Positioned between these sources is a photo diode 36 which senses the presence of the markings 20 on the web 12 as the web passes over the web guide 16. In operation, the sources 32, 34 concentrate radiation, such as infra red radiation of about 7950 angstroms or ultraviolet light of about 3660 angstroms, to an area of the web directly beneath the photo diode 36. When the incident radiation strikes a mark 20 it causes a wavelength shifted output to be emitted from that mark.

Interposed between the web 12 and the photo diode 36 is a filter 38 for filtering out electromagnetic radiation of wavelengths other than the wavelength shifted radiation emitted by the marks. The filter 38 enhances sensitivity by preventing ambient, web-reflected, or incident radiation of a wavelength other than the wavelength-shifted radiation emitted by the marks from reaching the detector. Mark detection is enhanced by constructing the web guide support 18 to be adjustable to allow the distance between the web and the photo diode 36 to be optimized.

Exemplary circuitry 30 for generating control voltages in response to the presence of the web markings is shown mounted inside the detector unit 10 on a printed circuit board 110. That circuitry 30 is electrically connected to the photo diode 36 in the detector unit 10. Three amplifiers 112, 114, 116 respond to changes in photo diode resistance with changes in electromagnetic radiation intensity from the marking 20 to generate an output 118 to a flip flop 120. When this output goes high it is an indication that a leading edge 40 (FIG. 1) of a mark 20 has passed beneath the detector.

Figure 3:
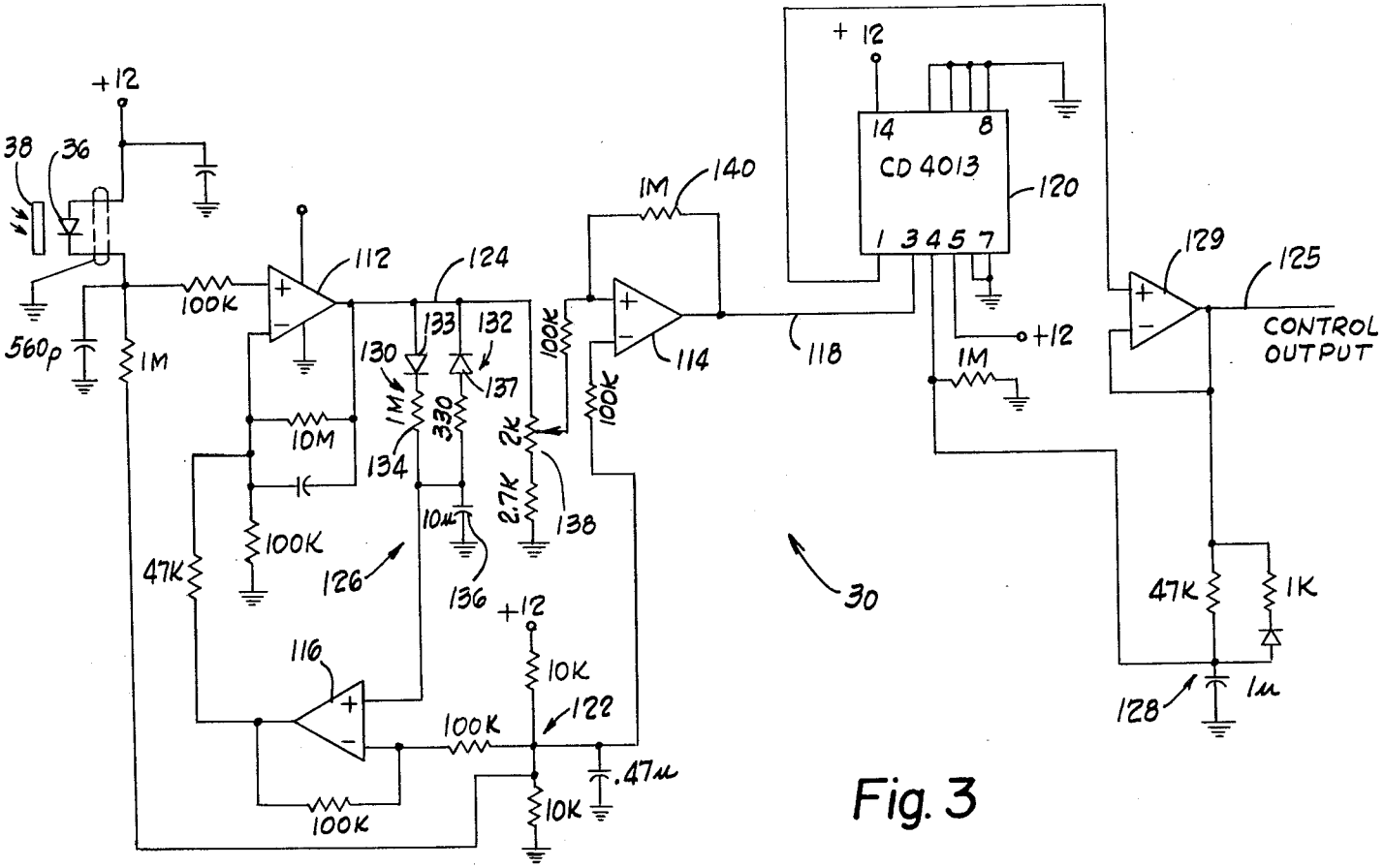
FIG. 3 is a schematic of a detector circuit which generates a control output when a control mark is sensed.

As radiation from a mark impinges on the photo diode 36 with increasing intensity the resistance of the diode decreases. The anode of that diode 36 is connected to a 12 volt source and the cathode is coupled through a 1 megohm resistor to a voltage divider 122. As the resistance decreases with increased radiation intensity, the current through the 1 megohm resistor increases causing a larger voltage to appear at a noninverting (+) input to the first amplifier 112. This amplifier 112 is an operational amplifier, one such suitable amplifier being an LM324 op amp. The other operational amplifiers shown in FIG. 3 may also comprise LM324 op amps.

An output 124 from the first operational amplifier 112 is coupled to a second operational amplifier 114 and is further coupled to the inverting input of the first op amp 112 through a feedback network 126, which includes the third amplifier 116. The second op amp 114 includes a reference input and a noninverting input connected to the output 124. When the noninverting input signal is greater than the reference signal at the inverting input, the output 118 from the second operational amplifier 114 goes high. This output 118 is coupled to the flip flop 120 which serves to shape the irregular-shaped output 118 from the second amplifier 114 into a well defined output 125 of constant height and pulse width. The pulse width of this output 125 is determined by an RC network 128 coupled to pin 4 of the flip flop 120 through an output amplifier 129.

In operation, as the photo diode 36 resistance drops in response to increased radiation intensity, the output 118 goes high and a well defined voltage output from the flip flop is generated which can be used for control purposes. As the RC network 128 charges in response to a high output at flip flop pin #1, a one microfarad capacitor charges until a reset signal appears at pin 4. By changing the resistor and/or capacitor values of the RC network 128 the "on" time of the flip flop can be optimized.

The circuitry is particularly suited to sense changes in the radiation level caused by the wavelength-shifting marks and to distinguish those changes from background light intensity due to the type and color of the background web material supporting the markings. A light-colored or transparent web produces a higher ambient or background level of light than a dark-colored web so that markings on a dark background may provide less intense radiation than a web area with no markings but with a light background. For this reason the circuitry must be sensitive to changes in intensity and not merely to absolute intensity levels. The feedback network 126 provides this capability.

The feedback network 126 provides negative feedback to the amplifier 112 to minimize the response of that amplifier to gradual changes in sensed radiation intensity, yet enables the amplifier 112 to remain sensitive to abrupt changes in sensed radiation levels of predetermined magnitudes. The preferred feedback network 126 comprises two parallel-connected diode, resistor circuits 130, 132, a 10$\mu$ capacitor 136 and the third amplifier 116.

As the output from the first amplifier 112 increases slowly due to sensed changes in ambient radiation levels, the capacitor 136 is charged via the circuit 130 which includes a forward biased diode 133 and a 1 megohm resistor 134. As the capacitor 136 charges the voltage across it increases. This voltage level is coupled to the noninverting input of the third amplifier 116 whose output is transmitted to the inverting input of the first amplifier 112.

The capacitor 136 charges slowly so that the feedback input to the first amplifier's inverting input also changes slowly, trailing the noninverting input to the first amplifier. Since the output from the first amplifier is the difference in value between its two inputs, the signal 124 transmitted to the second amplifier 114 tends to be constant or relatively so in response to relatively gradual increases in sensed radiation levels.

When sensed radiation levels are gradually reduced the output from the amplifier 112 likewise tends to be reduced. This reduction in the voltage level of the output 124 permits the capacitor 136 to discharge through the circuit 132 which includes a diode 137, poled oppositely to the diode 133, and a 330 ohm resistor connected between the capacitor 136 and the output line 124. The capacitor 136 discharges gradually at the rate dependent upon the voltage level of the output 124. As a consequence the signal level input to the amplifier 116 is reduced and the reduced output from the amplifier 116 tends to increase the output signal level from the amplifier 112.

A sharp, sudden rise of the output from the first amplifier 112 due to the passage past the detector of a mark's leading edge 40 causes a large signal to appear at the noninverting input to the second amplifier 114, which triggers an output from the flip flop 120. When the abruptly increased voltage level appears on the output 124, the feedback network capacitor 136 cannot charge rapidly enough through the resistor 134 to significantly change the input to the feedback amplifier 116. The inverting input of the first amplifier then does not change appreciably until the flip flop has already generated its control output. From the above it is apparent that the circuitry 110 is sensitive to rapid increases in radiation intensity; but not to gradual changes in sensed radiation intensity.

Temperature variations in the vicinity of the detector unit 10 affect output of the amplifier 112 in a similar manner to variations in ambient light or web reflectivity. As the temperature increases, the conductivity of the diode 36 increases, but typically at a slow rate. The feedback network 126 responds to this change in diode current and causes the signal at the first amplifier's inverting input to track the slowly varying (with temperature) signal at the noninverting (+) input. This slow increase in current does not reduce the magnitude of the rapid change in current level required to produce a signal at the noninverting input to the second amplifier 114, which triggers the flip flop 120. Therefore, notwithstanding a temperature increase, the detector does not become responsive to changes in light intensity of somewhat less magnitude than produced from wave-shifting marks.

The output signal 124 from the first amplifier 112 passes through a variable rheostat 138 before reaching the noninverting input to the second amplifier 114. By adjusting the setting of this rheostat 138 during setup the user can optimize detector operation and sensitivity.

Adjustment of the rheostat 138 during detector setup insures the detector output is in response to abrupt changes in wave-shifted radiation from the markings 20 and not abrupt smaller changes in reflected light from the web 12. The rheostat setting is adjusted until the second amplifier 114 responds only to abrupt rather large changes in current through the diode 36 rather than abrupt small changes that might be caused by changes in the background web pattern.

A feedback resistor 140 gives the second amplifier hysteresis action and prevents that amplifier from oscillating on and off in the event the first amplifier output 124 is very close to the six volts provided by the voltage divider 122 to the inverting input to this second amplifier 114.

As a mark's trailing edge 42 (FIG. 1) passes beneath the photo diode 36 the capacitor 136 discharges rapidly through a 330 ohm resistor in the second 132 diode, resistor circuit. This capacitor discharge enables the circuitry 30 for the detection of the next leading edge 40 that passes beneath the detector unit 10.

While a preferred embodiment of the invention has been disclosed in detail, various modifications or alterations may be made therein without departing from the spirit or scope of the invention set forth in the appended claims.

I claim:

1. Apparatus for detecting the presence of indicia affixed to an article of manufacture to coordinate an article control function with article movement comprising:

(a) radiation responsive means mounted near a web path of travel to detect radiation from the indicia;

(b) level detection means having a first input coupled to said radiation responsive means and a second input feedback coupled to a detection means output to provide a bias input which causes the detection means output to change appreciably only in response to abrupt changes of radiation intensity from the web; and (c) means for sensing changes in said detection means output and for providing a control signal to initiate the control function.

2. The detector of claim 1 which further comprises a filter interposed between the web and the radiation responsive means to attenuate radiation of certain wavelengths while letting other wavelengths pass substantially unattenuated to the radiation responsive means.

3. The detector of claim 1 wherein the feedback coupling between the amplifiers second input and the amplifier output comprises voltage storage device for causing the voltage at the second input to follow the voltage at the first input for slowly varying changes in the first input voltage.

4. The detector of claim 1 or 3 wherein the radiation responsive means is sensitive only to radiation wavelengths in the infra red range.

5. The detector of claim 1 or 3 wherein the radiation responsive means is sensitive only to radiation wavelengths in the visible range.

6. A detector for sensing the presence of a mark on an article moving relatively to the detector comprising:

(a) radiation responsive means for sensing radiation intensity;

(b) means to illuminate said article with radiation of a wavelength that causes said mark to emit wavelength shifted radiation;

(c) filter means interposed between said article and said radiation responsive means to attenuate radiation other than radiation of the same wavelength as the wavelength shifted radiation; and (d) circuitry coupled to said radiation responsive means to generate a control output in response to abrupt changes in wavelength shifted radiation intensity as sensed by said radiation responsive means; said output being indicative of the presence of a mark on the article.

7. A detector for sensing the presence of a mark on an article moving relatively to the detector comprising:

(a) radiation responsive means for sensing radiation intensity;

(b) means for mounting said radiation responsive means in relation to an article path of travel;

(c) means coupled to said means for mounting to illuminate said article with radiation of a wavelength which causes said mark to emit wavelength shifted radiation;

(d) filter means interposed between said article and said radiation responsive means to attenuate radiation other than radiation of the same wavelength as the wavelength shifted radiation; and (e) circuitry coupled to said radiation responsive means to generate a control output in response to abrupt changes in wavelength shifted radiation intensity as sensed by said radiation responsive means; said output being indicative of the presence of a mark on the article.

8. The detector of claim 7 wherein said circuitry comprises difference means having a first input coupled to the radiation responsive means and a second input feedback coupled to an output through an energy storage device to provide a variable bias input to said difference means.

9. The detector of claim 6, 7 or 8 wherein the wavelength of said illuminating radiation and the shifted wavelength of the emitted radiation are both in the infra red range.

10. The detector of claim 6, 7 or 8 wherein the wavelength of said illuminating radiation is in the ultraviolet range and the shifted wavelength of the emitted radiation is in the visible range.

11. A detector for sensing the presence of a mark on an article moving relatively to the detector comprising:

(a) radiation responsive means for sensing radiation intensity;

(b) means to illuminate said article with radiation of a wavelength which causes said mark to emit wavelength shifted radiation;

(c) filter means interposed between said article and said radiation responsive means to attenuate radiation other than radiation of the same wavelength as the wavelength shifted radiation; and (d) circuitry coupled to said radiation responsive means to generate a control output in response to abrupt changes of predetermined magnitude in radiation intensity and to inhibit gradual changes in or a constant level of detected radiation from significantly contributing to or detracting from the predetermined magnitude; said output being indicative of the presence of a mark on the article.

12. A detector for sensing the presence of a mark on an article moving relatively to the detector comprising:

(a) radiation responsive means for sensing radiation intensity, said means also being responsive to temperature changes;

(b) means to illuminate said article with radiation of a wavelength which causes said mark to emit wavelength shifted radiation;

(c) filter means interposed between said article and said radiation responsive means to attenuate radiation other than radiation of the same wavelength as the wavelength shifted radiation; and (d) circuitry coupled to said radiation responsive means to generate a control output in response to abrupt changes of predetermined magnitude in radiation intensity, said circuitry including elements inhibiting gradual changes in or a constant level of temperature of the radiation responsive means from significantly contributing to or detracting from the predetermined magnitude; said output being indicative of the presence of a mark on the article.

13. In a method of sensing the presence of a mark on an article moving relatively to a detector, said mark having the capability of emitting radiation of a wavelength shifted from that of certain radiation directed upon the work, the steps comprising:

(a) illuminating the article with radiation of a wavelength that causes said mark to emit wavelength shifted radiation;

(b) attenuating radiation from said article and mark that is of different wavelength from the wavelength shifted radiation;

(c) detecting radiation of said shifted wavelength; and (d) generating a control output only in response to abrupt changes of predetermined mangitude in the detected radiation, said control output being indicative of the presence of a mark on the article.

14. In a method of sensing the presence of a mark on an article moving relatively to a detector, said mark having the capability of emitting radiation of a wavelength shifted from that of certain radiation directed upon the work, the steps comprising:

(a) illuminating the article with radiation of a wavelength that causes said mark to emit wavelength shifted radiation;

(b) attenuating radiation from said article and mark that is of different wavelength from the wavelength shifted radiation;

(c) detecting radiation of said shifted wavelength; and (d) generating a control output only in response to abrupt changes of predetermined magnitude in the detected radiation while inhibiting gradual changes in or a constant level of detected radiation from significantly contributing to or detracting from the predetermined magnitude, said control output being indicative of the presence of a mark on the article.

* * * * *